US008296998B2

(12) United States Patent
Stull

(10) Patent No.: US 8,296,998 B2
(45) Date of Patent: Oct. 30, 2012

(54) POWERED ACTUATOR

(75) Inventor: Edward J. Stull, Oxford, MI (US)

(73) Assignee: Turnstyle Intellectual Property, LLC, Georgetown, SC (US)

( * ) Notice: Subject to any disclaimer, the term of this patent is extended or adjusted under 35 U.S.C. 154(b) by 365 days.

(21) Appl. No.: 12/764,377

(22) Filed: Apr. 21, 2010

(65) Prior Publication Data

US 2010/0263285 A1 Oct. 21, 2010

Related U.S. Application Data

(63) Continuation-in-part of application No. 11/691,647, filed on Mar. 27, 2007, now Pat. No. 7,958,675.

(60) Provisional application No. 60/786,231, filed on Mar. 27, 2006, provisional application No. 60/831,900, filed on Jul. 19, 2006, provisional application No. 61/171,256, filed on Apr. 21, 2009, provisional application No. 61/239,465, filed on Sep. 3, 2009.

(51) Int. Cl.
*E05F 11/00* (2006.01)

(52) U.S. Cl. ..... 49/333; 49/388; 49/42

(58) Field of Classification Search ..... 49/390, 49/381, 388, 333, 334, 42; 16/86.1, 86.2
See application file for complete search history.

(56) References Cited

U.S. PATENT DOCUMENTS

| | | | |
|---|---|---|---|
| 28,205 | A | 5/1860 | Sill |
| 82,648 | A | 9/1868 | Smith |
| 163,084 | A | 5/1875 | Krom |
| 203,575 | A | 5/1878 | Arnn |
| 326,548 | A | 9/1885 | Crowfoot |
| 363,964 | A | 5/1887 | Philpott |
| 398,718 | A | 2/1889 | Ford |
| 447,819 | A | 3/1891 | Gorham |
| 571,237 | A | 11/1896 | Philpott |
| 780,623 | A | 1/1905 | Sisk |
| 911,694 | A | 2/1909 | Ashley |
| 920,305 | A | 5/1909 | Finch |
| 933,677 | A | 9/1909 | Smith |
| 1,126,067 | A | 1/1915 | Nolte |

(Continued)

FOREIGN PATENT DOCUMENTS

| | | |
|---|---|---|
| DE | 3513666 | 10/1986 |

(Continued)

OTHER PUBLICATIONS

International Search Report for PCT/US2005/001292 dated May 12, 2005.

(Continued)

*Primary Examiner* — Katherine W Mitchell
*Assistant Examiner* — Catherine A Kelly
(74) *Attorney, Agent, or Firm* — Carlson, Gaskey & Olds, P.C.

(57) ABSTRACT

An actuator includes an inner member that defines an inner space within which a motor is supported. An outer member is supported for rotation about the inner member. A drive slot in the inner member is shaped to cause rotational movement responsive to axial movement of a motor without relative axial movement of the outer member relative to the inner member. A drive pin moved by the motor moves within the drive slot and is engaged to a drive channel of the outer member to facilitate rotation of the outer member about the axis.

17 Claims, 8 Drawing Sheets

U.S. PATENT DOCUMENTS

| | | | | | |
|---|---|---|---|---|---|
| 1,221,796 | A | | 4/1917 | Egbert | |
| 1,383,961 | A | | 7/1921 | Melugin | |
| 1,462,766 | A | | 7/1923 | Post | |
| 1,494,911 | A | | 5/1924 | Heselschwerdt | |
| 1,540,490 | A | | 6/1925 | Mertel | |
| 1,594,260 | A | | 7/1926 | Herr | |
| 1,630,200 | A | | 5/1927 | Merrill | |
| 1,891,739 | A | | 12/1932 | Wenger | |
| 1,947,733 | A | | 2/1934 | Peremi et al. | |
| 2,050,584 | A | | 8/1936 | Peremi et al. | |
| 2,111,773 | A | | 3/1938 | Hagenbook | |
| 2,151,052 | A | | 3/1939 | Smart et al. | |
| 2,181,464 | A | | 11/1939 | Renner | |
| 2,251,482 | A | | 8/1941 | Curtiss, Jr. | |
| 2,564,485 | A | | 8/1951 | Kurstin et al. | |
| 2,686,941 | A | * | 8/1954 | Patten | 49/366 |
| 2,924,843 | A | | 2/1960 | Tykeson | |
| 3,264,949 | A | | 8/1966 | Dietlin | |
| 3,315,413 | A | * | 4/1967 | Beecher et al. | 49/280 |
| 3,364,620 | A | | 1/1968 | Hess et al. | |
| 3,626,547 | A | | 12/1971 | Werner | |
| 3,717,954 | A | | 2/1973 | Sheckells | |
| 4,122,630 | A | * | 10/1978 | Parisien | 49/386 |
| 4,124,955 | A | | 11/1978 | Kochis | |
| 4,174,621 | A | | 11/1979 | Woltjen | |
| 4,231,190 | A | | 11/1980 | Tieben | |
| 4,295,297 | A | | 10/1981 | Carroll et al. | |
| 4,472,908 | A | | 9/1984 | Wanzl et al. | |
| 4,572,595 | A | | 2/1986 | Craig | |
| 4,649,597 | A | | 3/1987 | Cacicedo | |
| 4,651,969 | A | | 3/1987 | Dowdall | |
| 4,658,543 | A | | 4/1987 | Carr | |
| 4,665,650 | A | | 5/1987 | Hall | |
| 4,731,886 | A | | 3/1988 | Heinrich et al. | |
| 4,813,293 | A | | 3/1989 | Fink | |
| 4,968,910 | A | | 11/1990 | Meier et al. | |
| 4,989,368 | A | | 2/1991 | Trikilis | |
| 5,035,082 | A | | 7/1991 | Butler | |
| 5,036,620 | A | | 8/1991 | Beran et al. | |
| 5,050,344 | A | | 9/1991 | Skeem | |
| 5,133,152 | A | | 7/1992 | Grancagnolo | |
| 5,134,923 | A | | 8/1992 | Wexler | |
| 5,138,796 | A | | 8/1992 | Grainger | |
| 5,215,290 | A | | 6/1993 | Khalessi | |
| 5,277,488 | A | | 1/1994 | Cleary et al. | |
| 5,373,664 | A | | 12/1994 | Butler | |
| 5,557,889 | A | | 9/1996 | Sharp | |
| 5,564,367 | A | | 10/1996 | Boyanton | |
| 5,904,115 | A | | 5/1999 | Durbin et al. | |
| 6,119,399 | A | | 9/2000 | McCain et al. | |
| 6,990,772 | B2 | | 1/2006 | Eckel et al. | |
| 7,367,891 | B2 | | 5/2008 | Bae | |
| 7,506,860 | B2 | | 3/2009 | Stull | |
| 7,942,386 | B2 | | 5/2011 | Stull | |
| 7,958,675 | B2 | | 6/2011 | Stull | |
| 2003/0178280 | A1 | | 9/2003 | Eto et al. | |
| 2005/0156149 | A1 | | 7/2005 | Stull | |
| 2007/0221904 | A1 | | 9/2007 | Stull | |
| 2008/0237561 | A1 | | 10/2008 | Cozby | |
| 2008/0244978 | A1 | | 10/2008 | Soyugenc | |
| 2009/0084037 | A1 | | 4/2009 | Bzorgi | |
| 2009/0119996 | A1 | | 5/2009 | Wang | |
| 2010/0319262 | A1 | | 12/2010 | Stull | |

FOREIGN PATENT DOCUMENTS

| | | |
|---|---|---|
| DE | 20121216 | 7/2002 |
| EP | 0152210 | 8/1985 |
| EP | 0743464 | 11/1996 |
| EP | 1143096 | 10/2001 |
| GB | 585176 | 1/1947 |
| JP | 3-14273 | 2/1991 |
| JP | 7-6499 | 1/1995 |
| JP | 9-72176 | 3/1997 |
| JP | 10-169342 | 6/1998 |
| JP | 11-62444 | 3/1999 |
| JP | 11-131954 | 5/1999 |
| JP | 2000-226964 | 8/2000 |
| JP | 2001-295233 | 10/2001 |
| WO | 02/18737 | 3/2002 |
| WO | 2005/073494 | 8/2005 |

OTHER PUBLICATIONS

International Search Report and Written Opinion for PCT/US2007/065016 mailed on Oct. 1, 2007.

International Search Report and Written Opinion for PCT/US2008/066847 mailed on Nov. 26, 2008.

International Search Report and Written Opinion for PCT/US2009/032538 mailed on Jun. 11, 2009.

International Preliminary Report on Patentability PCT/US2008/066847 mailed on Dec. 30, 2009.

International Preliminary Report on Patentability for PCT/US2009/032538 mailed on Aug. 12, 2010.

* cited by examiner

POWERED ACTUATOR

CROSS REFERENCE TO RELATED APPLICATIONS

The application claims priority to U.S. Provisional Application No. 61/171,256 filed on Apr. 21, 2009 and U.S. Provisional Application No. 61/239,465 filed on Sep. 3, 2009, and is a continuation in part of U.S. application Ser. No. 11/691,647 filed on Mar. 27, 2007 now U.S. Pat. No. 7,958,675, which claims priority to U.S. Provisional Application No. 60/786,231 filed on Mar. 27, 2006 and U.S. Provisional Application No. 60/831,900 filed on Jul. 19, 2006.

BACKGROUND OF THE INVENTION

This disclosure generally relates to an actuator for moving a panel, door or other member between desired positions. More particularly, this disclosure relates to an easily installable device for moving a panel, door or other member that converts linear movement into rotational movement.

Many applications exist where it is desirable to move a panel, door or other member between relative rotary positions about a fixed axis. Doors, gates and other movable members are often mounted to rotate about a fixed axis. The fixed axis being disposed at one side of the door, gate or panel. Typically, movements of these members are facilitated by hinges and moved by an external motor that drives linkage to move the door, panel or member between desired positions. Such actuators and linkages are complicated, and often susceptible to damage either purposeful or through simple exposure to the elements.

SUMMARY OF THE INVENTION

An example actuator includes an inner member that defines an inner space within which a motor is supported. An outer member is supported for rotation about the inner member. A drive slot in the inner member is shaped to cause rotational movement responsive to linear movement without any residual relative axial movement between inner and outer members. A drive pin moved by the motor moves within the drive slot and is engaged to a drive channel of the outer member to facilitate rotation of the outer member about the axis.

These and other features of the present invention can be best understood from the following specification and drawings, the following of which is a brief description.

DESCRIPTION OF THE PREFERRED EMBODIMENT

Figure 1:
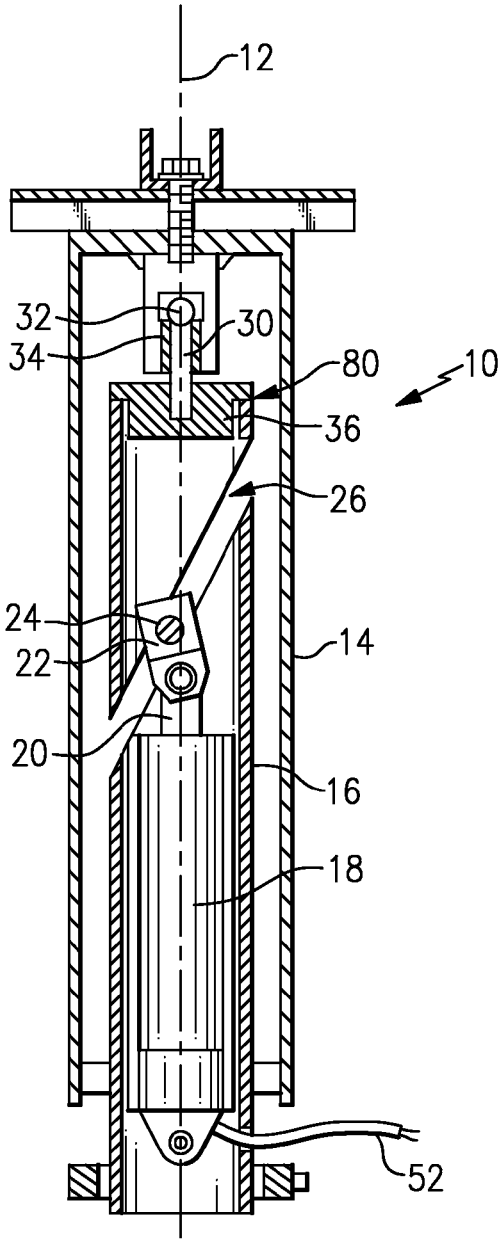
FIG. 1 is a schematic view of an example powered actuator.
Figure 3:
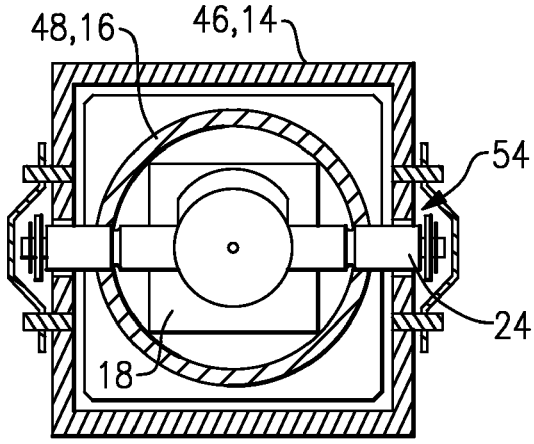
FIG. 3 is a cross-sectional view of a portion of the example powered actuator.

Referring to FIG. 1, an example powered actuator assembly 10 provides for powered movement of a closure panel such as for example a gate, door, or other panel member. The actuator 10 includes an inner member 16 that is mountable to a support structure, such as for example within the ground. The inner member 16 supports an outer member 14. The actuator 10 includes a motor 18 that drives a drive pin 24 disposed within a drive slot 26. The example motor 18 is disposed entirely within the inner member 16 and therefore is hidden from view. A trunion 22 links a shaft 20 of the motor 18 to the drive pin 24. The motor 18 is mounted to the inner member and the drive pin 24 is movable within the drive slot 26 and extends into a drive channel in the outer member 14 (FIG. 3). Linear movement of the motor 18 is converted in to pure rotational movement of the outer member 14 without any relative axial movement of the outer member 14 relative to the inner member 16.

Figure 2:
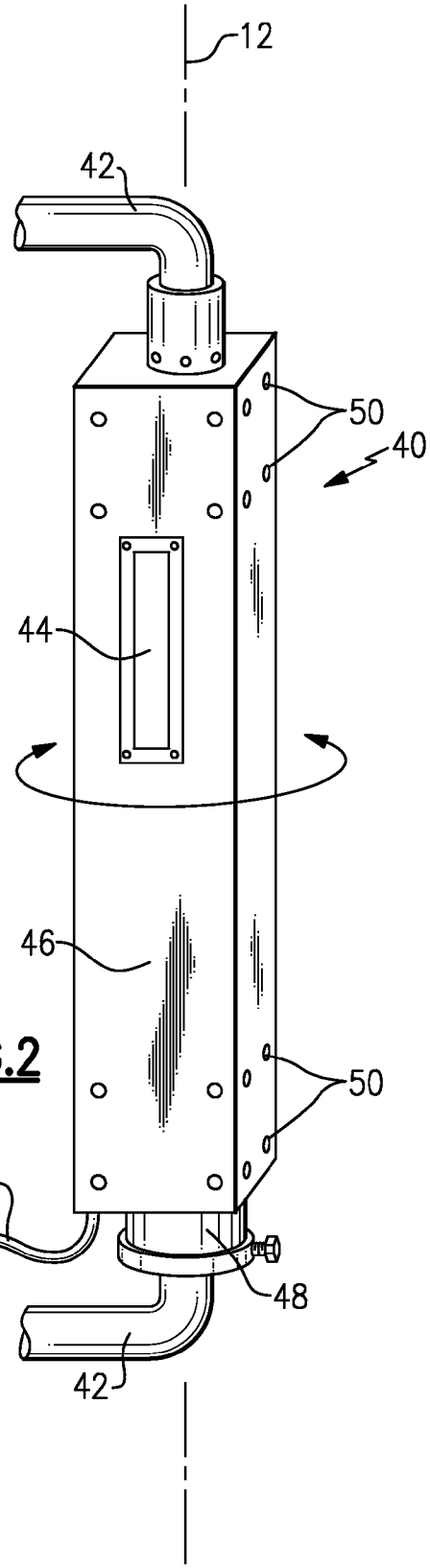
FIG. 2 is a perspective view of another example powered actuator.

Referring to FIG. 2, another example actuator assembly 40 includes mounting brackets 42 for mounting to a fixed structure. The motor 18 is mounted within an inner member 48, to rotate an outer member 46. An access panel 44 is provided to gain access to internal components. Mounting screws 50 facilitate mounting of a closure or other member to the rotating outer member 46. A power cord 52 communicates electrical power to the motor 18. FIGS. 1 and 2 illustrate different example embodiments utilizing the similar structure of an outer member rotatable about a fixed inner member. The different examples illustrate different mounting methods, and as such also demonstrate that other configurations for mounting to accommodate different structures that benefit from the disclosed powered actuator.

Figure 4:
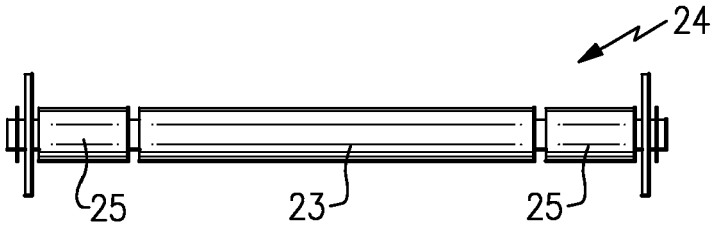
FIG. 4 is a plan view of an example drive pin.

Referring to FIGS. 3 and 4 with continuing reference to FIG. 1, the example motor 18 is a linear electric motor that includes a ball screw shaft 20. Movement of the motor 18 linearly moves the drive pin 24 within the drive slot 26 to cause a corresponding rotation of the drive pin 24 and thereby the outer member 14. The drive pin 24 moves within the drive slot 26 and is disposed within the vertical drive channels 54 within the outer member 46. The drive slot 26 includes a shape that rotates the drive pin 24 about the axis 12 responsive to vertical movement. No axial movement is transferred to the outer member 46. The vertical drive channels 54 within the outer member 46 does not include a twisting helical shape, but are instead straight vertical slots to accommodate vertical movement of the drive pin 24 such that the outer member 46 does not move axially responsive to the linear movement provided by the motor.

The example drive pin 24 includes a center section 23 and two distal bearing sections 25. The bearing sections 25 engage the drive channels 54 within the outer member 14. The center section 23 is connected to the motor shaft 20.

Figure 5:
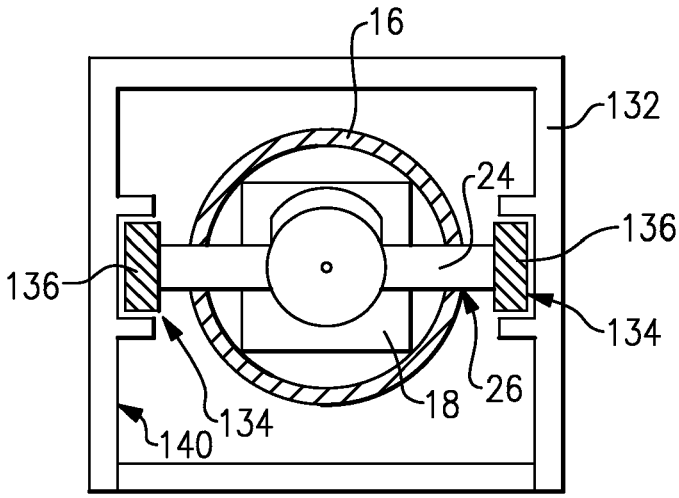
FIG. 5 is a cross-sectional view of an example outer post.
Figure 6:
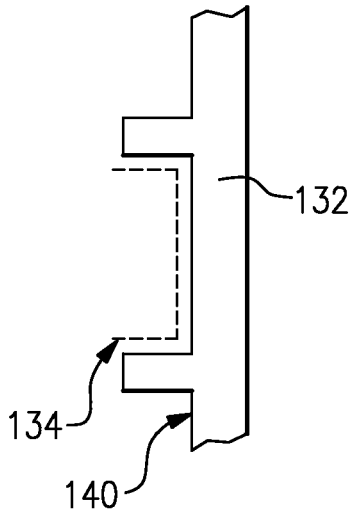
FIG. 6 is a partial sectional view of a section of the outer post shown in FIG. 5.

Referring to FIGS. 5 and 6, another example outer member 132 includes integral drive channels 134 disposed on an internal surface 140. The drive channels 134 receive guide blocks 136 that are attached to the drive pin 24. The drive pin 24 moves vertically responsive to movement of the motor 18. The vertical movement is translated into rotational movement by the drive slots 26 of inner member 16. The guide blocks 136 slide vertically within the drive channels 134 to translate the rotational movement of the drive pin 24 into rotation of the outer housing 132. Moreover, the drive channels 134 prevent the translation of any axial movement to the outer housing 132. In other words, no relative axial movement between the inner member 16 and the outer housing 132 is present. The only relative movement between the inner member 16 and the outer housing 132 is the rotation caused by translation of axial movement of the drive pin within the drive slots 26.

Figure 7:
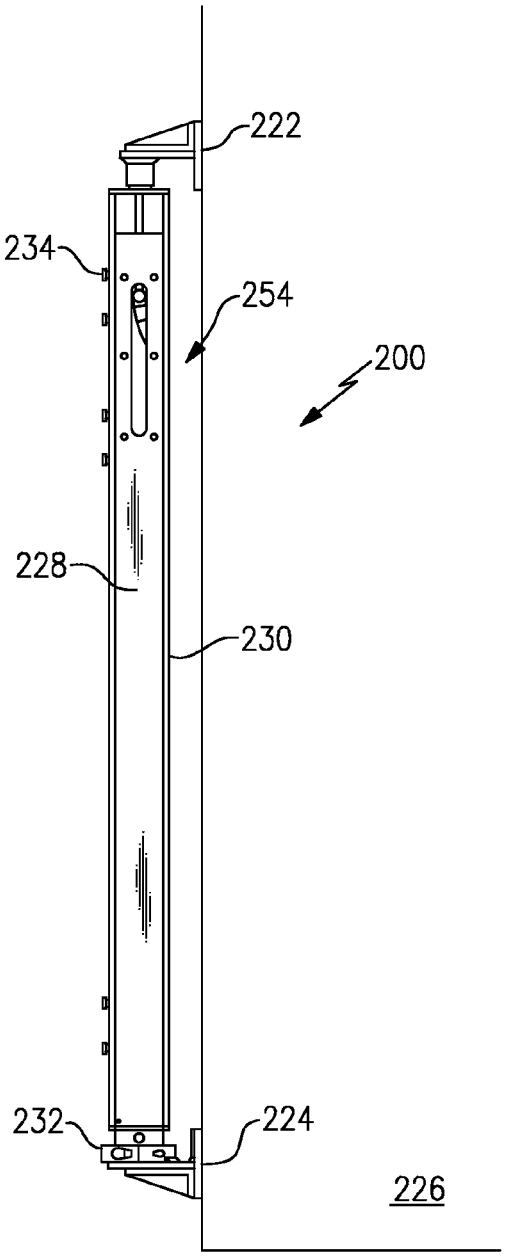
FIG. 7 is a schematic view of another powered actuator.
Figure 8:
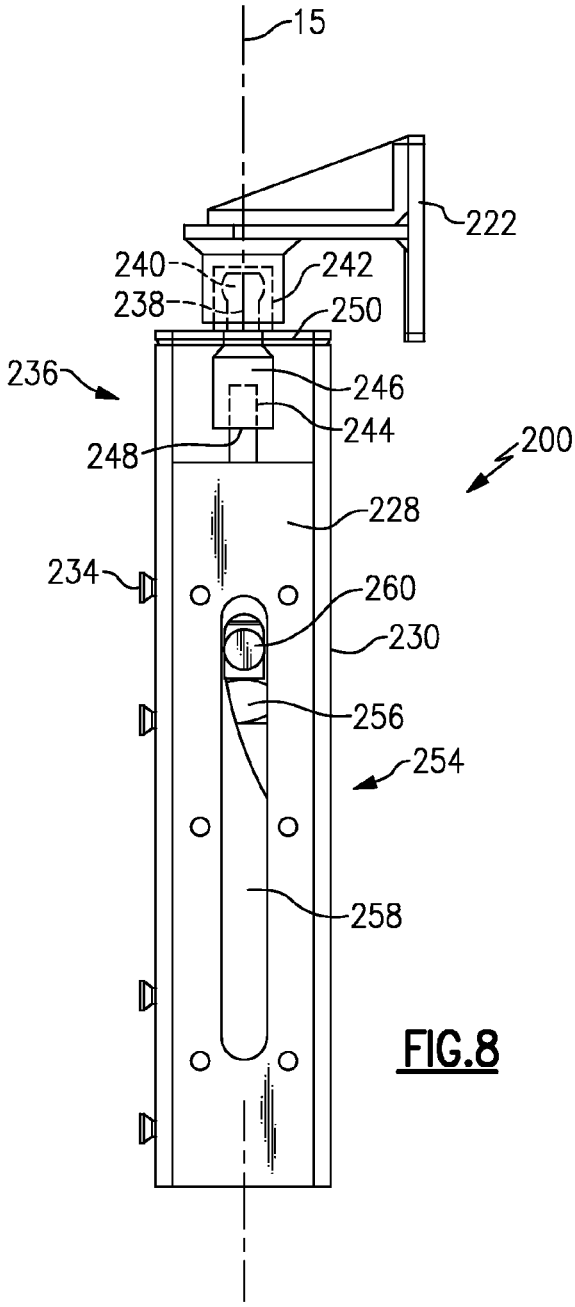
FIG. 8 is a partial sectional view of the powered actuator shown in FIG. 7.
Figure 9:
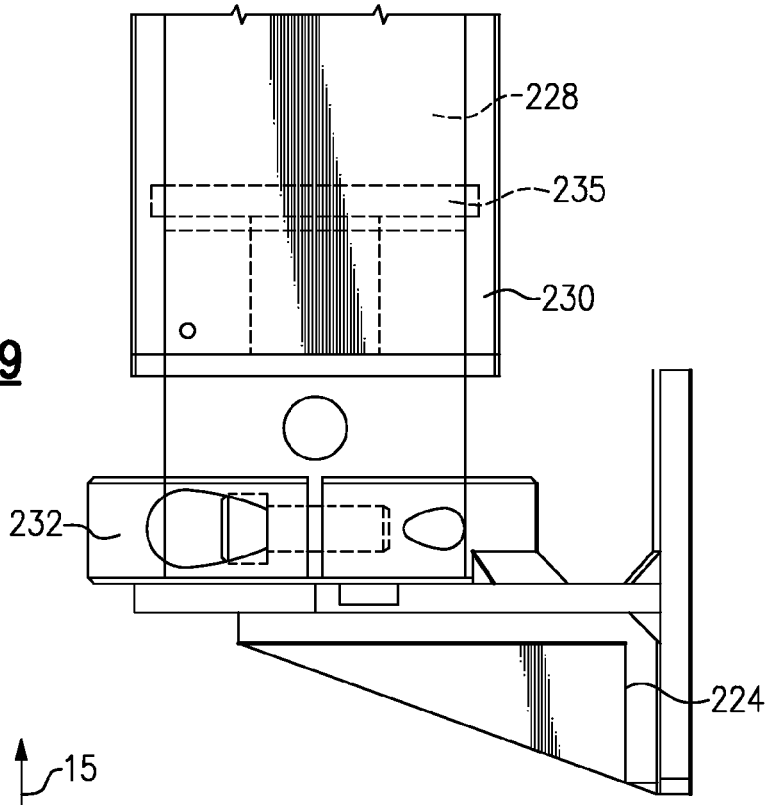
FIG. 9 is a partial sectional view of a portion of the powered actuator shown in FIG. 7.

Referring to FIGS. 7, 8 and 9, another powered actuator 200 includes an inner tube 228 and an outer tube 230. The inner tube 228 has a substantially circular cross-section, and the outer tube 230 has a substantially square cross-section. The example outer tube 230 includes sides approximately three inches long. In this example, both the inner and outer tubes 228, 230 are made of steel. As appreciated, the use of other materials and shapes are within the contemplation of disclosure and could be utilized to form portions of the tubes 228 and 230. Such as for example, the outer tube 230 could be of a circular cross-section that is larger than the inner tube 228. Further, the outer tube 230 could include a different unique shape tailored to a specific application.

The inner tube 228 is clamped to a lower bracket 224 such that it is fixed relative to a fixed structure 226. A bottom of the inner tube 228 is clamped with a clamp 232. Therefore, the inner tube 228 is stationary and does not rotate, and the outer tube 230 and any structure or closure attached to the outer tube 230 will rotate relative to the inner tube 228. A lower bearing 235 is provided in the radial space between the inner tube 228 and the outer tube 230. The bearing 235 maintains a desired relative spacing between the inner and outer tubes 228, 230 during operation. The example bearing 235 is fabricated from a plastic material that reduces any frictional interference between relative the outer tube 230 and the inner tube 228. Fasteners 234 are shown attached to the outer tube 230 to facilitate mounting of a closure structure (not shown).

Referring to FIG. 8, a mounted journal 236 fitted within an upper bracket 222 is attached to the outer tube 230. The example mounting journal 236 can be fabricated from any materials such as steel or other composite structures. The mounting journal 236 includes a post 238 with a semi-spherical element 240 that engages a recess 242 within an upper bracket 222. The mounting journal 236 also includes a cylinder 252 with a bore 244. A single support bearing 246 is supported within the bore 244. The support bearing 246 rests on a pin 248 of a support 228 received within the bore 244 of the mounting journal 236. The outer tube 230, along with anything mounted to the outer tube 230 is supported on and rotates on the support bearing 246. The mounting journal 236 also includes a flange 250 secured to the outer tube 230.

The example powered actuator 200 includes a rotating mechanism 254. The rotating mechanism includes a motor disposed within an inner space defined by the inner tube 228. The inner tube 228 includes two helical drive slots 256 spaced approximately 180° apart relative to the axis 15 of the inner tube 228 (only one drive slot 256 is partially shown in FIG. 8), and the outer tube 230 includes two vertical driven slots 258 spaced approximately 180° apart (only one driven slots 258 shown in FIG. 8). Each helical drive slot 256 is associated with one of the vertical driven slots 258. A drive bearing 260 attached to an end of the motor (not shown here) guides within each set of slots 256 and 258 to drive rotation of the outer tube 230 relative to the fixed inner tube 228 in response to vertical movement of the drive bearing 260. Movement of the drive bearing 260 vertically within the drive slots 256 moves the drive bearing 260 in the slots 256 and 258 and determines the amount of rotation of the outer tube 230 about the axis 15. As the outer tube 230 rotates, the semi-spherical element 240 rotates within the upper bracket 22 and maintains a desired alignment. The linear movement along the axis encountered by the drive bearing 260 is not translated to axial movement of the outer tube 230. Instead, the linear movement is translated into pure rotational movement lacking any relative axial movement between the outer tube 230 and the inner tube 228. In other words, the outer tube 230 maintains the relative axial relationship with the inner tube 228 during rotation.

Figure 10:
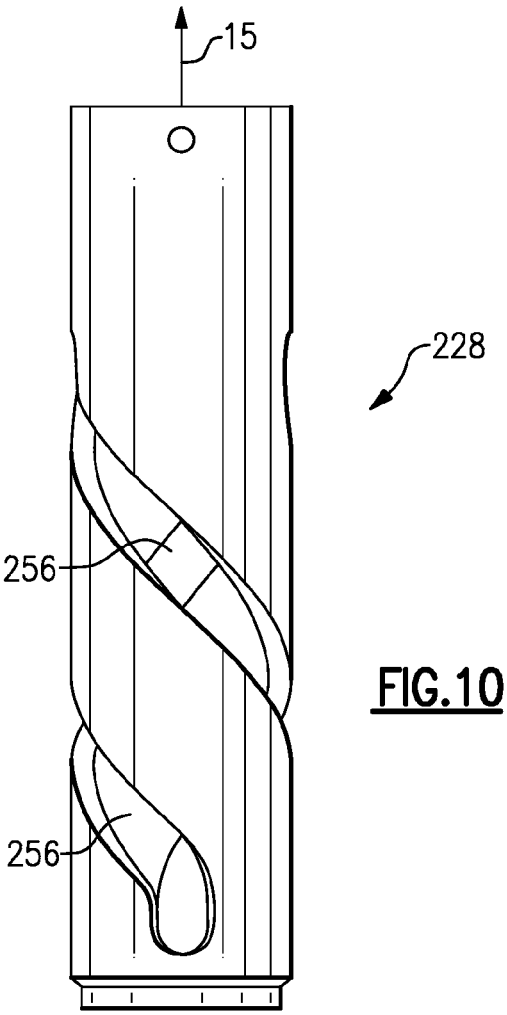
FIG. 10 is a side view of an example inner tube including two 270° drive slots.
Figure 11:
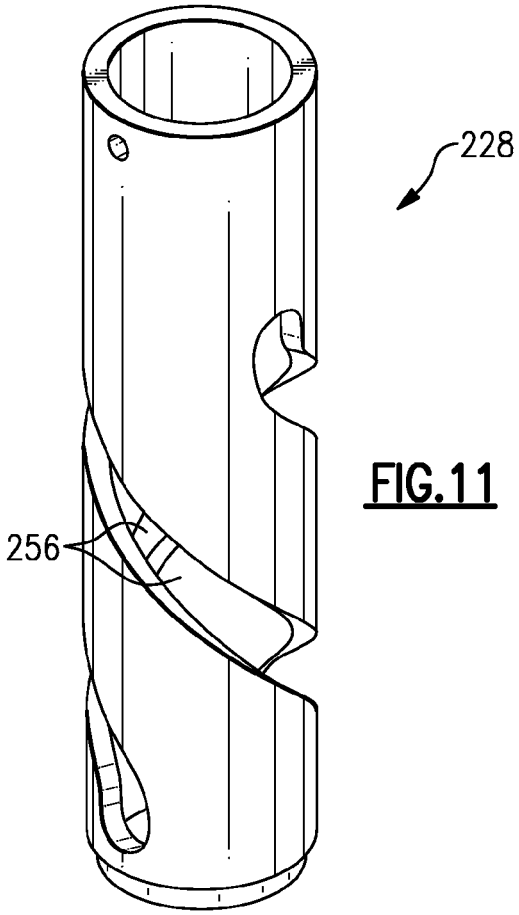
FIG. 11 is a perspective view of the example inner tube of FIG. 10.

Referring to FIGS. 10 and 11 with continued reference to FIG. 8, the helical guide slots 256 define movement of the drive bearings 260 along the helical guide slots 256 such that the outer tube 230 rotates approximately 270°. That is, any one side of the outer tube 230, and thereby any panel, door or other member attached thereto is provided with a defined rotation within a range of 270° between extreme positions. In this example, the helical guide slots 256 extend approximately 270° around the inner tube 228 relative to the axis 15. The helical guide slots 256 can extend other circumferential distances about the inner tube 228 to define other ranges of rotation.

Figure 12:
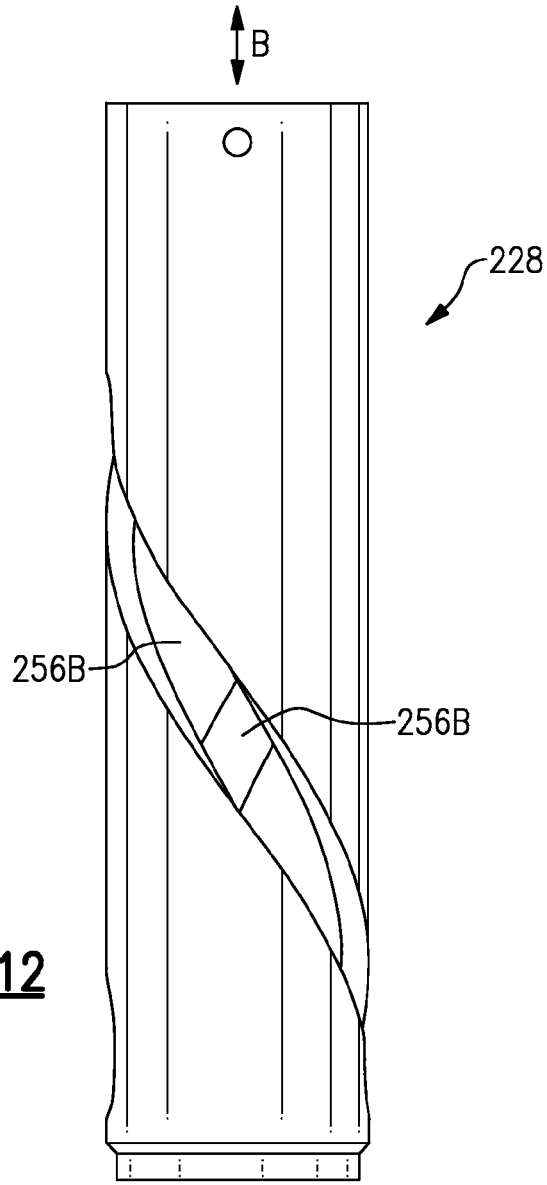
FIG. 12 is a side view of an inner tube including two 180° drive slots.
Figure 13:
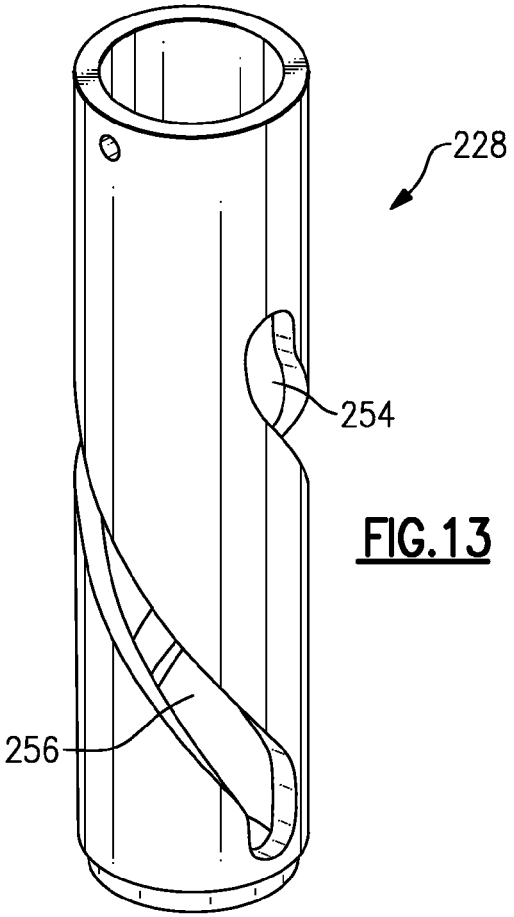
FIG. 13 is a perspective view of the example inner tube of FIG. 12.

Referring to FIGS. 12 and 13, another example guide slot 256B is disposed approximately 180° around the inner tube 228. Accordingly, a range of movement of approximately 180° is provided for the outer tube 230 relative to the inner tube 228.

Figure 14:
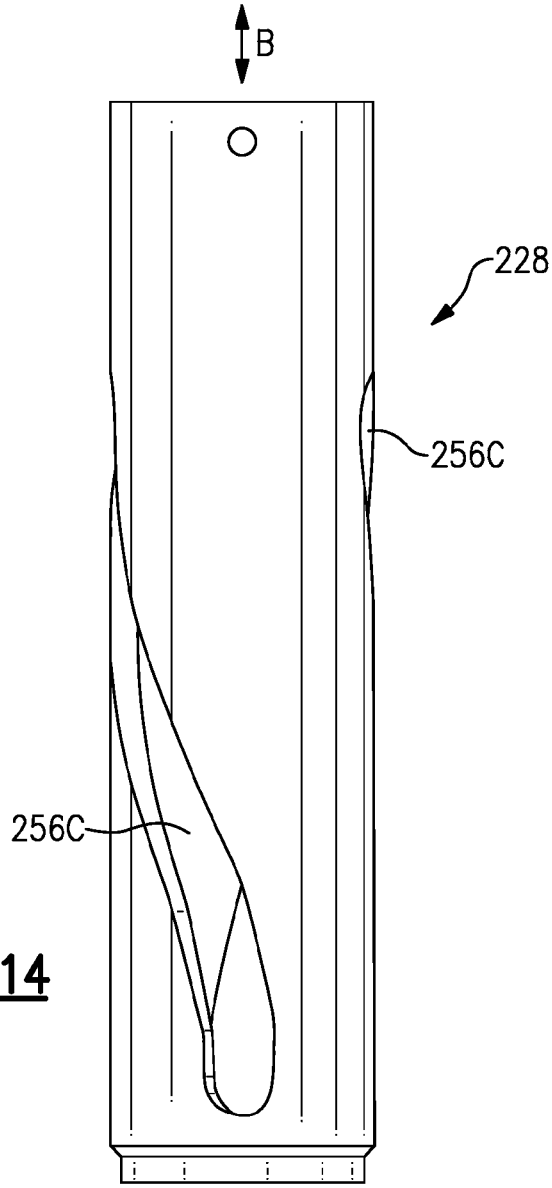
FIG. 14 is a side view of an inner tube including two 90° drive slots.
Figure 15:
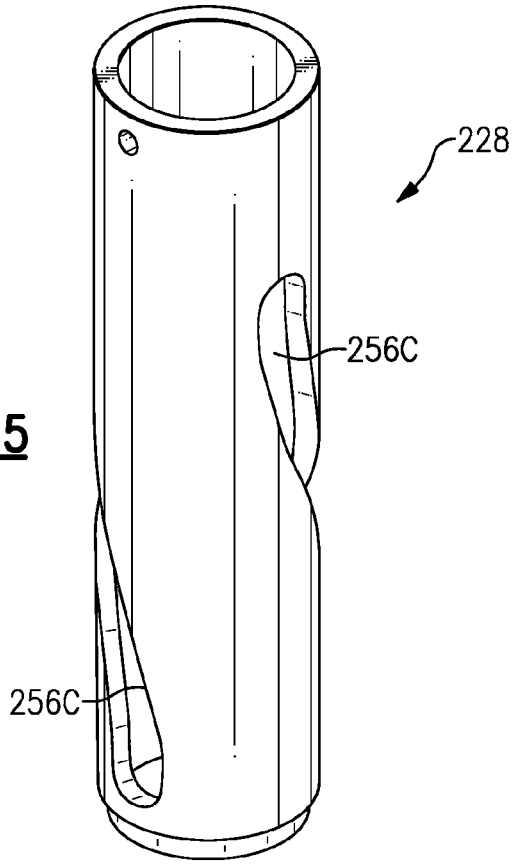
FIG. 15 is a perspective view of the inner tube of FIG. 14.

Referring to FIGS. 14 to 15, in another example, helical guide slots 256C extend approximately 90° around the inner tube 228. The helical guide slots 256C therefore provide movement of the drive bearings 260 along the helical guide slots 256C such that the outer tube 230 can move within a range of approximately 90°. The amount of rotation of the outer tube 230 and therefore any associated door, panel or closure panel can be tailored as desired by the degree that the helical guide slots 256 extend around the inner tube 228. Moreover, the rotational movements defined by the various disclosed helical shapes and lengths do not result, nor cause relative axial movement between the inner tube 228 and the outer tube 230. Moreover, a speed or rate that the outer tube 230 rotates relative to the inner tube 228 can be tailored by adjusting shape and configuration of the helical slots.

Figure 16:
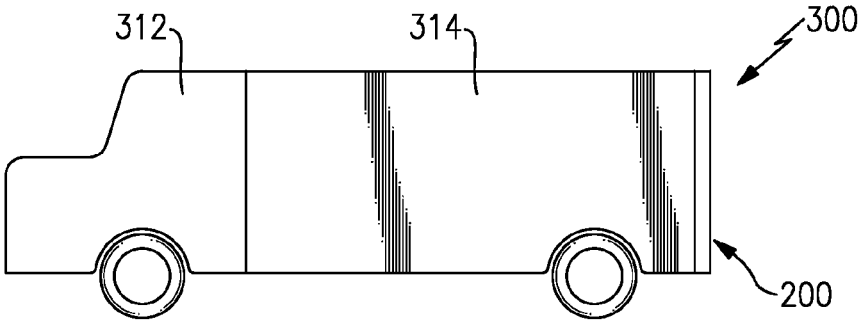
FIG. 16 is a schematic view of an example truck trailer including powered actuators.
Figure 17:
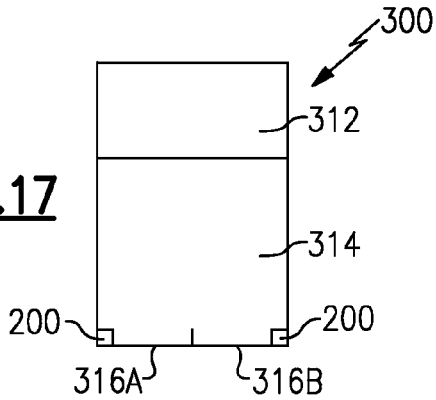
FIG. 17 is a schematic view of the example trailer with doors in a closed position.
Figure 18:
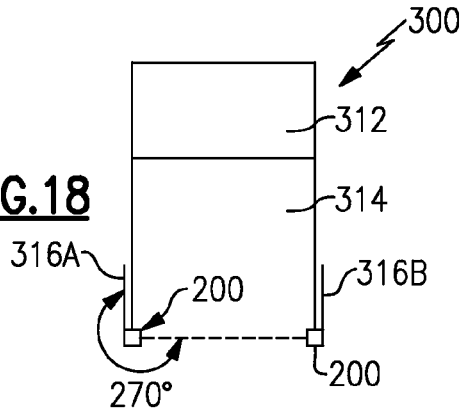
FIG. 18 is a schematic view of the example trailer with doors in an open position.

Referring to FIGS. 16, 17 and 18, an example truck 300 includes a tractor 312 that tows a trailer 314. The trailer 314 includes rear doors 316A and 316B that are moveable between a closed position (FIG. 17) and an open position (FIG. 18). Each of the example doors 316A, 316B are attached to a powered actuator 200 as previously shown a described. The powered actuator 200 is in turn mounted to the sides of the trailer 314. The example actuator 200 can be mounted using the brackets 222 and 224 as is shown in FIG. 7, and/or may be mounted using other similarly configured mounting bracket.

In operation, when it is desired to open the doors 316A, 316B, the powered actuator 200 is supplied power to engage the motor (Best shown in FIG. 1) to drive the drive bearing 260 within the drive slot 230. The motor drives the drive bearing 260 along the axis vertically within the drive slot 230. Depending on the amount of helical twist provided in the inner tube 228, the drive bearing 260 rotates about the axis 15 of the actuator 200 responsive to movement along the axis within the drive slot. In this example, the inner tube 228 the drive slot 256 comprises a helical twist that extends 270° about the inner tube 228 (FIGS. 10 and 11). As appreciated, other helical twist configurations could be utilized to tailor the range of movement of the doors 316A, 316B. In this example the 270° helical slots provides for each door to open such that it can fold along side the sides of the trailer 314. The rotation of the outer tube 230 is the only relative rotation because all linear movement is translated into rotational movement. The channels or slots within the outer tube 230 prevent any relative axial movement between parts, thereby resulting in a pure rotational movement without any axial component.

Movement of the drive bearing 260 within the drive slot 256 vertically causes a corresponding rotation of the drive bearing 260. Because ends of the drive bearing 260 are engaged to the slot 258 within the outer tube 230, this rotation is transferred to the outer tube 230. The rotation of the outer tube 230 facilitates opening of the doors 316A, 316B. Moreover, the extent that the drive slots 256 twist about the inner tube 228 provides the allowed range of rotation. The outer tube 230 could be rotated a lesser amount about the inner tube 228. Closing of the doors 316A, 316B is accomplished by reversing movement of the drive bearing within the drive slot 256.

Figure 19:
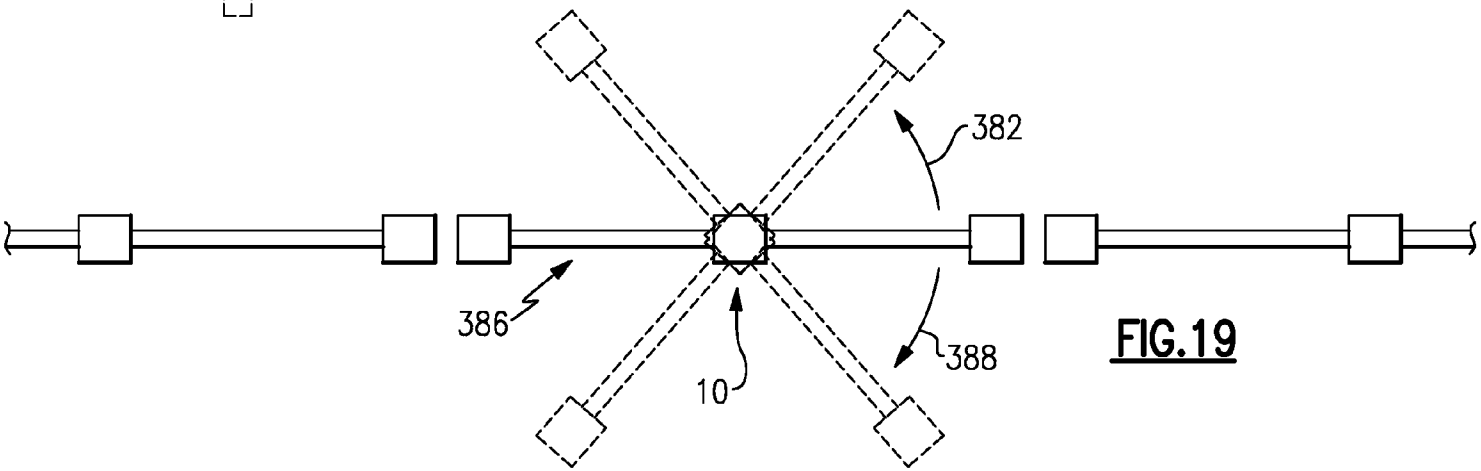
FIG. 19 is a schematic view of an example gate including a powered actuator.

Referring to FIG. 19, with reference to FIG. 1, the example powered actuator 10 (FIG. 1) can be utilized as a gate post assembly for opening a gate 386 about a central axis either clockwise 384 or counterclockwise 382. Rotation about the central axis provides for application to rotating gates that are supported for rotation by one central powered actuator 10. The example powered actuator 10 will include an inner member 16 that includes a slot configuration for providing the desired movement between open and closed positions of the gate 386.

Figure 20:
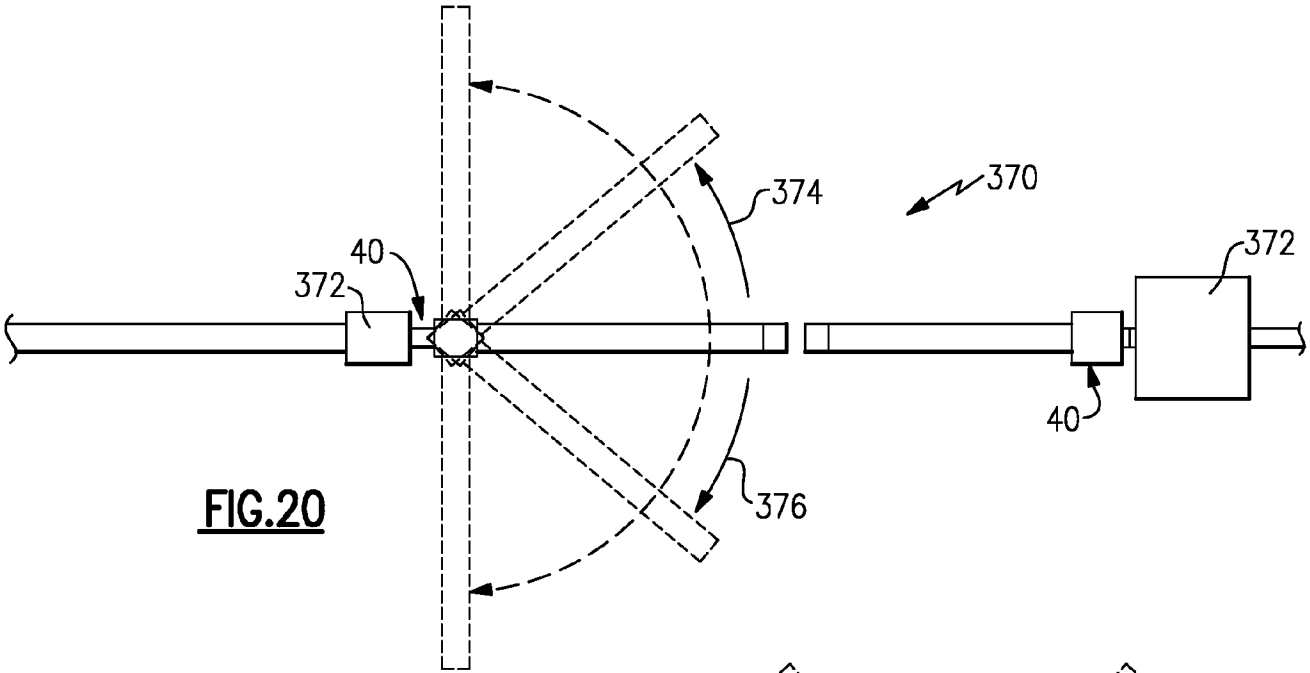
FIG. 20 is a schematic view of another example gate including powered actuators.

Referring to FIG. 20 with reference to FIG. 2, another example gate 370 is supported for movement by the actuator 40 (FIG. 2). The actuator 40 is in turn attached to the fixed structure 372. Rotation of the actuator 40 is utilized to open the gate 370 either in a first direction 374, or in a second direction 376 as is desired. The example actuator 40 therefore provides for movement through approximately 270°. As appreciated, different ranges of movement could be utilized to provide any desired range of movement.

Accordingly, the disclosed and describe powered actuators provide for mounting and powered movement of closure panels, doors, gates and any other structure that is desired to be moved between various positions. The actuators include features that provide for tailoring the range of movement to accomplish application specific requirements. Furthermore, the disclosed actuators translate linear movement along an axis into pure rotational movement without any residual or accompanying relative axial movement.

Although an example has been explained and disclosed, a worker of ordinary skill in this art would recognize that certain modifications would come within the scope and contemplation of this disclosure. For that reason, the following claims should be studied to determine the true scope and content of this invention.

What is claimed is:

1. A powered actuator assembly comprising:

a non-rotatable inner member defining an open inner space and including a drive slot;

an outer member rotatable about the inner member including a drive channel;

a single ball bearing centered along an axis of rotation of the outer member, wherein the single ball bearing supports the outer member on the inner member;

a motor disposed within the open inner space of the inner member; and a drive pin driven by the motor and extending through the drive slot into the drive channel that rotates the outer member relative to the inner member without any vertical movement of either member along the axis of rotation.

2. The assembly as recited in claim 1, including a support attached to one of the inner member and the outer member, and a sleeve attached to the other of the inner member and the outer member, with the single ball bearing disposed between the support and the sleeve.

3. The assembly as recited in claim 1, wherein the drive slot comprises first and second drive slots on opposing sides of the inner member and the drive channel comprises first and second drive channels on opposing sides of the outer member with the drive pin extending through each of the first and second drive slots into the first and second drive channels.

4. The assembly as recited in claim 3, wherein the drive slot comprises an upper portion and a lower portion wherein the upper drive slot facilitates rotation of the outer member in a first direction and the lower drive slot facilitates rotation of the outer member in a second direction opposite the first direction.

5. The assembly as recited in claim 1, wherein the drive slot comprises a shape that causes rotation of the drive pin responsive to axial movement provided by the motor.

6. The assembly as recited in claim 1, wherein the drive slot comprises cycloid shape.

7. The assembly as recited in claim 1, wherein the motor comprise an electric motor that drives a shaft axially along the axis of rotation.

8. The assembly as recited in claim 1, wherein the motor comprises a rotary electric motor that moves a threaded member axially responsive to rotation about the axis or rotation.

9. The assembly as recited in claim 1, wherein the motor drives a gear train for rotating the outer member relative to the inner member.

10. An actuator for moving a closure member comprising:

an inner member fixed relative to rotational movement of the closure member, the inner member having a drive slot;

an outer member supported for movement about an axis of rotation on the inner member, wherein the closure is attached to the outer member;

a single ball bearing centered along an axis of rotation of the outer member, wherein the single ball bearing supports the outer member on the inner member;

a motor disposed within the open inner space of the inner member; and a drive pin driven by the motor and extending through the drive slot into the drive channel for rotating the outer member relative to the inner member without any vertical movement of either member along the axis of rotation.

11. The assembly as recited in claim 10, including a support attached to one of the inner member and the outer member and a sleeve attached to the other of the inner member and the outer member with the single ball bearing disposed between the support and the sleeve.

12. The assembly as recited in claim 10, wherein the drive slot comprises first and second drive slots on opposing sides of the inner member and the drive channel comprises first and second drive channels on opposing sides of the outer member with the drive pin extending through each of the first and second drive slots into the first and second drive channels.

13. The assembly as recited in claim 10, wherein the drive slot comprises a helical shape that provides for movement of the closure member about the axis approximately 270 degrees.

14. The assembly as recited in claim 10, wherein the drive slot comprises a helical shape that provides for movement of the closure member about the axis of rotation approximately 180 degrees.

15. The assembly as recited in claim 10, wherein the drive slot comprises cycloid shape.

16. The assembly as recited in claim 10, wherein the motor comprise an electric motor that drives a shaft axially along the axis of rotation.

17. The assembly as recited in claim 10, wherein the drive slot provides relative rotational movement between the inner member and the outer member without any relative axial movement between the inner member and the outer member.

* * * * *